US009030282B2

(12) United States Patent
Pieteris

(10) Patent No.: US 9,030,282 B2
(45) Date of Patent: May 12, 2015

(54) PERMANENT MAGNET DC INDUCTOR

(75) Inventor: Paulius Pieteris, Espoo (FI)

(73) Assignee: ABB Oy, Helsinki (FI)

( * ) Notice: Subject to any disclaimer, the term of this patent is extended or adjusted under 35 U.S.C. 154(b) by 0 days.

(21) Appl. No.: 12/700,252

(22) Filed: Feb. 4, 2010

(65) Prior Publication Data

US 2010/0194512 A1 Aug. 5, 2010

(30) Foreign Application Priority Data

Feb. 5, 2009 (EP) ..... 09152140

(51) Int. Cl.

| | |
|---|---|
| ***H01F 21/00*** | (2006.01) |
| ***H01F 27/24*** | (2006.01) |
| ***H01F 17/06*** | (2006.01) |
| ***H01F 37/00*** | (2006.01) |
| ***H01F 3/14*** | (2006.01) |
| *H01F 3/10* | (2006.01) |

(52) U.S. Cl.

CPC ..... *H01F 37/00* (2013.01); *H01F 3/14* (2013.01); *H01F 27/24* (2013.01); *H01F 2003/103* (2013.01)

(58) Field of Classification Search

USPC ..... 336/110, 178, 212, 214–216, 233; 335/181, 266, 230, 234, 26, 229, 306; 310/23, 30, 40, 235, 236

See application file for complete search history.

(56) References Cited

U.S. PATENT DOCUMENTS

| | | | | |
|---|---|---|---|---|
| 2,860,313 | A * | 11/1958 | Israel | 336/110 |
| 4,533,890 | A * | 8/1985 | Patel | 335/234 |
| 4,928,028 | A * | 5/1990 | Leibovich | 310/23 |
| 5,642,249 | A * | 6/1997 | Kuznetsov | 361/58 |
| 5,821,844 | A | 10/1998 | Tominaga et al. | |
| 6,066,998 | A * | 5/2000 | Trumper et al. | 335/229 |
| 6,933,827 | B2 * | 8/2005 | Takeuchi et al. | 336/212 |
| 7,111,595 | B2 * | 9/2006 | Sedda et al. | 123/90.11 |
| 7,518,269 | B2 * | 4/2009 | Lee | 310/12.24 |
| 7,686,597 | B2 * | 3/2010 | Ries | 417/416 |
| 7,847,663 | B2 * | 12/2010 | Sodo | 336/110 |
| 2009/0009277 | A1 | 1/2009 | Sodo | |

FOREIGN PATENT DOCUMENTS

| | | | |
|---|---|---|---|
| EP | 0744757 | A1 | 11/1996 |
| EP | 2012327 | A2 | 1/2009 |
| JP | 2006-222387 | A | 8/2006 |
| JP | 2007-123596 | A | 5/2007 |

OTHER PUBLICATIONS

European Search Report for EP 09152140.1 dated Jun. 25, 2009.

* cited by examiner

*Primary Examiner* — Mangtin Lian

(74) *Attorney, Agent, or Firm* — Buchanan Ingersoll & Rooney PC

(57) ABSTRACT

A permanent magnet DC inductor is disclosed which includes at least two separate and individual magnetic inductors, each having its own core structure and forming closed individual magnetic paths having at least one magnetic gap. Windings are provided on the magnetic cores, and at least one permanent magnet piece is provided with each inductor. The separate magnetic cores having the at least one magnetic gap are arranged against each other to form external magnetic gaps with the permanent magnet pieces arranged inside the external magnetic gaps on both sides of the at least one magnetic gap.

20 Claims, 6 Drawing Sheets

PERMANENT MAGNET DC INDUCTOR

RELATED APPLICATION

This application claims priority under 35 U.S.C. §119 to European Patent Application No. 09152140.1 filed in Europe on Feb. 5, 2009, the entire content of which is hereby incorporated by reference in its entirety.

FIELD

The present disclosure relates to inductors, such as inductors having permanent magnets in a core structure and designed for direct current applications.

BACKGROUND INFORMATION

DC inductors are used as passive components in a DC link of AC electrical drives. A known practice is to use two separate inductors, one on DC positive and the other on DC negative bus bars. This approach is the size and mass of the inductors. There are also known cases of using single core inductors, which have two windings wound on the same core and each of them is meant to carry currents either on the DC positive or DC negative bus bars. In addition to the above, such a single core inductor can have a drawback because of a very high coupling coefficient between two windings. If some abnormal phenomenon occurs on the DC positive bus bar, then it can be automatically reflected on the negative DC bus bar, and vice versa. DC inductors can be used as filters for reducing harmonics in line currents in an input side rectifier system of an AC drive.

The use of permanent magnets in the DC inductors can allow for minimizing a cross-sectional area of the inductor core, thereby saving core and winding material and the needed space. The permanent magnets can be arranged in the core structure in such a way that a magnetic flux or the magnetization produced by the permanent magnets is opposite to that obtainable from the coil wound on the core structure. The opposing magnetization of the coil and permanent magnets makes the resulting flux density smaller and thus enables smaller cross-sectional dimensions in the core to be used.

As is known, permanent magnets have an ability to become de-magnetized if an external magnetic field is applied to them. This external magnetic field has to be strong enough and applied opposite to the magnetization of the permanent magnet for permanent demagnetization. In the case of a DC inductor having a permanent magnet, demagnetization may occur if a considerably high current is led through the coil and/or if the structure of the core is not designed properly. A current that may cause demagnetization may be a result of a malfunction in an apparatus to which the DC inductor is connected.

Known DC inductors with permanent magnets are based on core structures that have either permanent magnets inside a core magnetic gap or are specifically designed to hold the magnets with projecting structures or the magnets are directly attached to the outer surface of the structure designed specifically to use the permanent magnets. An example of a DC reactor is shown in EP 0744757 B1, where the permanent magnets are attached to the outer surface of the structure or inside the winding window.

Known DC inductors which include permanent magnets to the core structure or inside the core structure can be complicated and insecure. Additionally, extra back yokes are used for a permanent magnet return flux. The permanent magnet pieces are also quite fragile and do not tolerate mechanical impacts. Further, the inductance provided by one core structure is not easily modified in the existing inductors with permanent magnets. This is because if permanent magnet dimensions need to be modified, the whole inductor core structure or at least part of it should be modified.

SUMMARY

A permanent magnet DC inductor is disclosed, comprising: at least two separate and individual magnetic inductors, each having a core structure and forming closed individual magnetic paths having at least one magnetic gap; a winding provided on each core structure; and at least one permanent magnet piece for each core structure, wherein the core structures having the at least one magnetic gap are arranged against each other to form external magnetic gaps, with the permanent magnet pieces arranged inside the external magnetic gaps and the at least one permanent magnet piece arranged on both sides of the at least one magnetic gap.

BRIEF DESCRIPTION OF THE DRAWINGS

In the following, various objects and advantages will be described in greater detail with reference to exemplary embodiments and the attached drawings, in which.

DETAILED DESCRIPTION

An integral permanent magnet double core DC inductor is disclosed which can be formed from two complete and separate inductors by placing one or more permanent magnets between the structures. The permanent magnets being situated outside the separate core structures at the same time can provide magnetic and physical coupling between the two individual inductors. When the permanent magnet pieces are arranged between the separate core structures, the individual inductor structures together form an integral magnetic path for the magnetization obtained by the permanent magnet(s). Thus, the permanent magnet(s) operate to oppose the magnetization obtained by the coils of the individual inductors and exemplary advantages of using permanent magnet(s) can be achieved. Moreover, the number of permanent magnets used for proper operation can be reduced at least by half if compared to cases of individual permanent magnet inductors as, for example, in EP 0744757 B1 and JP2007123596.

Since one or more permanent magnets are placed between the separate inductors, they are also safe from mechanical impacts. This can be further improved by using a permanent magnet holder according to an exemplary embodiment of the disclosure, which can be used to cover the permanent magnets completely. Thus, ultimate protection from external physical impact can be achieved. Additionally, the permanent magnet holder can ensure an exact positioning of the permanent magnets between the cores. Further, assembly of the permanent magnets and the whole integral inductor can be easy since the magnet(s) are simply placed on substantially flat surfaces.

Exemplary embodiments of the present disclosure can allow differing inductances to be easily obtained by modifying either magnetic gaps inside the individual inductors, magnetic gaps between the individual inductors, magnetic gaps between the individual inductors formed by the placement of permanent magnets or dimensions of the permanent magnets.

Figure 1:
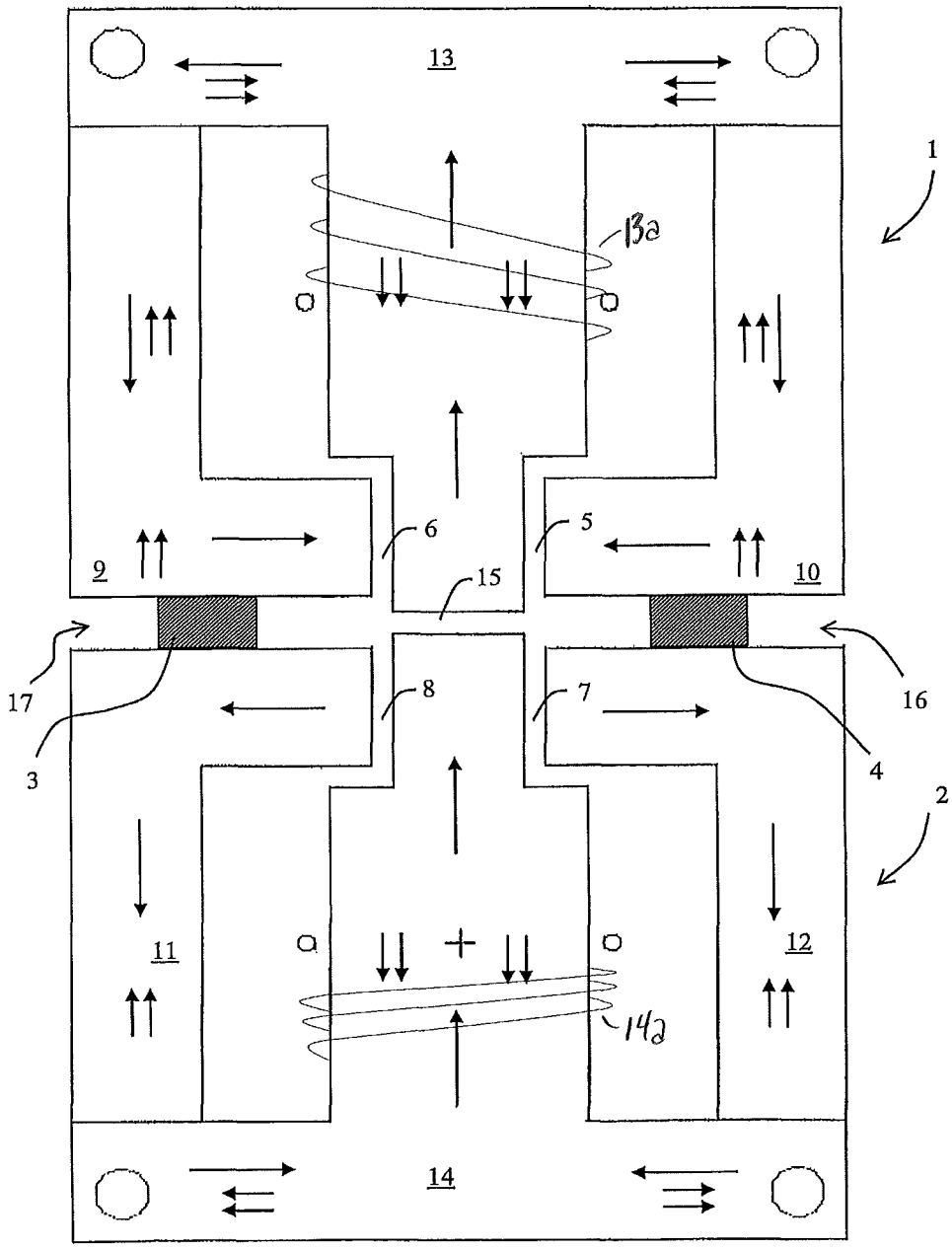
FIGS. 1, 2, 3, 4 and 5 show exemplary embodiments of the present disclosure.

FIG. 1 illustrates a front view of an exemplary integral permanent magnet double core DC inductor as disclosed herein. The inductor of the disclosure includes two separate magnetic cores 1, 2 which both form a magnetic path by themselves. The magnetic path of the separate magnetic cores includes one or more magnetic gaps (e.g., air gaps 5, 6, 7, 8). The separate inductor structures may be operable as regular inductors or chokes.

In FIG. 1, the separate inductors 1 and 2 are formed of two L-shaped structures 9, 10, 11, 12 forming side legs of the inductor and of modified T-shape structures 13, 14 forming a center leg of the inductor. The center leg is narrower in its open end and forms together with the shorter sides of the L-shaped structures the magnetic gaps. A winding or coil (13*a*, 14*a*) of the inductor can be arranged on the center legs 13, 14 of the separate inductors.

According to an exemplary embodiment of the disclosure, permanent magnet pieces 3, 4 are arranged in magnetic gaps 16 and 17 between the separate inductors 1, 2 in such a manner that the at least one magnetic gap 5, 6, 7, 8 provided in the magnetic paths is between the permanent magnet pieces. In this way, a magnetic flux of the permanent magnets runs through the whole core structure as desired.

In the exemplary embodiment of FIG. 1, the polarities of the permanent magnet pieces correspond to each other. This is to say that magnetic flux is produced with both permanent magnet pieces upwards in the drawing. The magnetic flux of the permanent magnets is shown by parallel arrows in FIG. 1. The flux runs from the permanent magnets 3 and 4 upwards in the legs 9 and 10, through the center leg 13 and crossing a magnetic gap 15. The flux travels further after the magnetic gap 15 in the magnetic core 2 in a reverse order (e.g., through the center leg 14 and closing the path through the side legs 11 and 12 to the permanent magnet pieces 3 and 4).

The magnetic flux path obtainable by the coils is illustrated as longer and single arrows in FIG. 1. The flux can be considered as originating from the center legs. In the upper inductor 1 the flux runs from the center leg 13 and through the L-shaped side legs back to the center leg. Thus, the flux formed in the upper inductor core stays in the same core. Similarly, in the inductor 2 the flux runs from center leg 14 to side legs 11, 12 and returns back to center core. The magnetic gap 15, which is between the center legs of the two separate inductors, can be used as a magnetic coupling adjustor. As the fluxes produced by the coils in both of the center cores flow in the same direction, part of those fluxes might couple through the magnetic gap 15. In such a case, magnetic coupling directly contributes to mutual and total inductances of the integral permanent magnet double core DC inductor. It is seen in FIG. 1 that the fluxes producible with the windings and fluxes of the permanent magnet oppose each other, thus reducing the flux density in the desired manner.

Since the fluxes that are produced by the individual inductor windings stay in the same core structure, the permanent magnet pieces are not prone to demagnetization. Further, the flux from the coil of the inductor 2 supports the permanent magnet flux in the vicinity of the permanent magnet. In the L-shaped core structures 11, 12 below the permanent magnets in FIG. 1, the flux of the coil has the same general direction as that of the permanent magnets. On the other hand, above the permanent magnet pieces, in the vicinity of the magnets, the flux of the coil of the inductor 1 opposes the permanent magnet flux. This can further eliminate the possibility of demagnetizing the permanent magnet.

According to an exemplary embodiment of the disclosure, the integral permanent magnet double core DC inductor structure forms two chokes (e.g., a double pack). In some applications, a single inductor can be substituted by two inductors having half the inductance of one. This is the case, for example, in connection with DC link chokes in a frequency converter. In such a case, both rails of the DC link are equipped with inductors. Thus, the inductors are in series with each other when current enters the positive rail of the link and exits from the negative rail of the link.

With the common permanent magnets for two separate inductors, the integral permanent magnet double core DC inductor of the present disclosure can be well suited for the above use, since the volume occupied by the inductor is considerably smaller compared to that of two separate inductors having the same inductance. Further, when two similar separate cores are joined together by the permanent magnets, as disclosed herein, the inductances for both core structures are the same.

Figure 2:
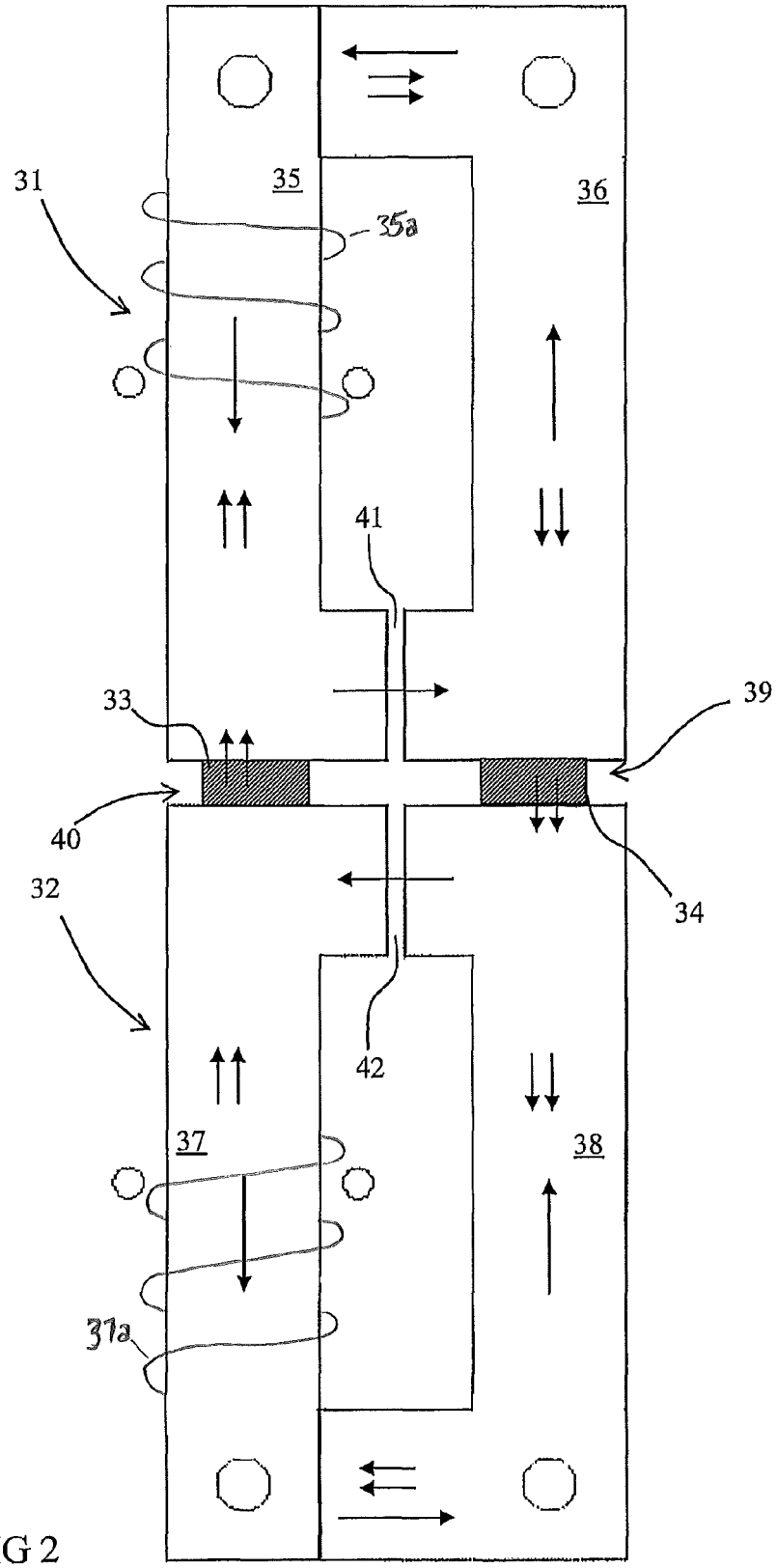

FIG. 2 shows another exemplary embodiment of the present disclosure. In this embodiment, the separate magnetic cores 31, 32 are formed of two L-shaped structures 35, 36, 37, 38. In FIG. 2, the coils or windings (35*a*, 37*a*) of the inductor are, for example, wound over legs formed from the structures 35 and 37.

The exemplary embodiment of FIG. 2 differs from the embodiment of FIG. 1 in that there is no center leg in FIG. 2. As seen in FIG. 2, the magnetic flux produced by the permanent magnets circles around the whole structure (double arrows) clockwise and the permanent magnet pieces are arranged with differing polarities inside magnetic gaps 39, 40 between the separate inductors (e.g., the direction of magnetic flux from one permanent magnet piece 33 is up and from the other permanent magnet piece 34 down).

The magnetic fluxes producible with the coils have a differing direction (single arrows) and these fluxes do not travel from one inductor core structure to another, but they close via magnetic gaps 41, 42. The flux from permanent magnets, on the other hand, travels a route of the smallest reluctance, which is, as mentioned above, via the core structures of separate inductors with no magnetic gaps in the case of FIG. 2. As in FIG. 1, since the fluxes that are produced by the individual inductor windings stay in the same core structure, the permanent magnet pieces are not prone to demagnetization. Further, the flux from the coil of the inductor 32 supports the permanent magnet flux in the vicinity of the permanent magnet 33. At the same time, the flux from the coil of the inductor 31 supports the permanent magnet flux in the vicinity of the permanent magnet 34. This can further eliminate the possibility of demagnetizing the permanent magnet.

Figure 3:
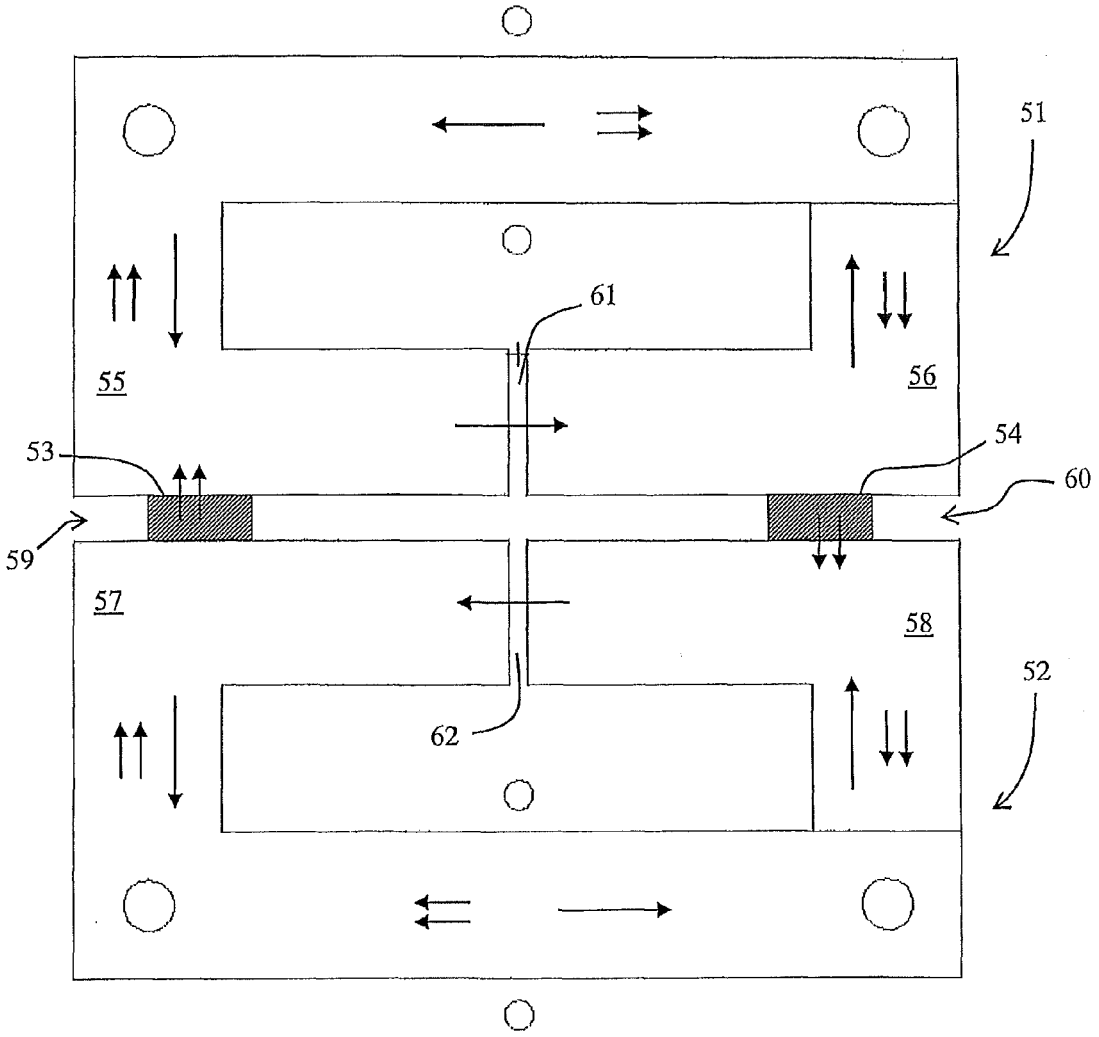

FIG. 3 shows another exemplary embodiment of the present disclosure similar to that of FIG. 2. In FIG. 3, separate core structures 51, 52 are formed of two L-shaped structures 55, 56, 57, 58. Permanent magnets 53, 54 are inserted in magnetic gaps 59, 60 between the two individual inductors 51 and 52. The windings can, for example, be wound over legs (e.g., formed from structures 55 and 57).

As in connection with FIG. 2, the magnetic fluxes producible by the windings circulate in the respective separate structures of the individual inductors as indicated by the long arrows. The fluxes of the permanent magnets 53, 54, on the other hand, do not pass magnetic gaps 61, 62 provided in the individual core structures. As above, the directions of the fluxes from the windings and from the permanent magnet pieces oppose each other. Therefore, the magnetic flux density in the core material can be lowered.

Figure 4:
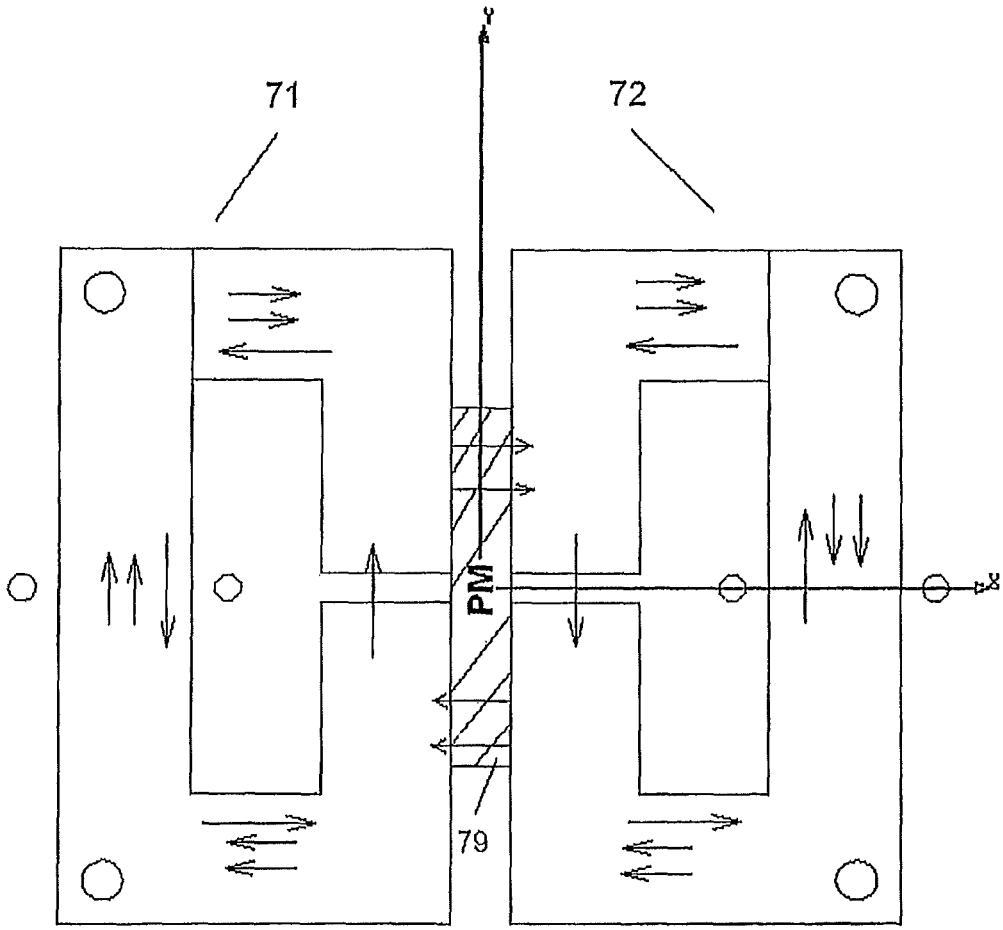

FIG. 4 shows another exemplary embodiment of the present disclosure similar to that of FIG. 3, only instead of two separate permanent magnets a single piece magnet 79 is placed between the two separate chokes 71 and 72. The single piece permanent magnet is magnetized in two different directions (e.g., upwards and downwards). The functioning principle of the embodiment of FIG. 4 is similar to that of FIG. 3. The same measures of permanent magnet protection as in the above cases apply.

An inductance—current (L-I) curve of the inductors according to exemplary embodiments of the present disclosure can be easily modified by using permanent magnet pieces of different physical dimensions with no need to make any modifications to the original chokes.

Figure 5:
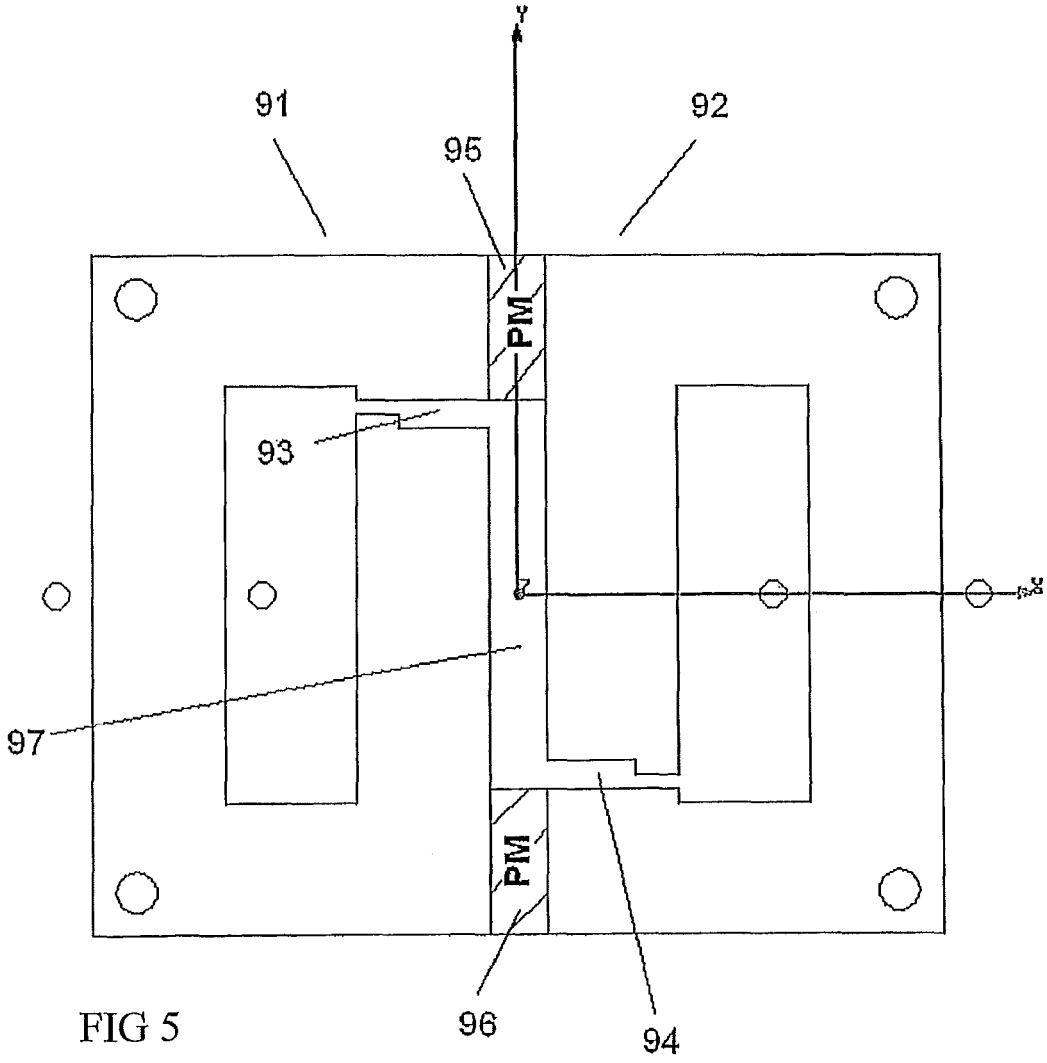

The magnetic coupling (e.g., leakage flux), between the separate cores in the integral permanent magnet double core DC inductor structure is minimal, and can be further adjusted by modifying magnetic gaps and their position between and inside the separate inductor structures. FIG. 5 shows an example in which the magnetic gaps inside the separate structures are moved such that magnetic gaps 93, 94 are offset (e.g, not directly opposite to each other). This kind of positioning of the magnetic gaps can greatly reduce the magnetic coupling between separate structures 91, 92. Thicker permanent magnet pieces 95, 96 also help to minimize the magnetic coupling between the separate structures since a gap 97 between the separate cores is larger. As also shown in FIG. 5, the magnetic gaps 93, 94 may be non-uniform, leading to swinging choke characteristics.

Exemplary embodiments of the present disclosure can enable the use of larger permanent magnets than known solutions. In FIGS. 1, 2, 3, and 4, the permanent magnets are shown as pieces occupying only a portion of the available space. However, the permanent magnet pieces may take the whole area between the opposing structures of the individual inductors. The larger the surface area of the permanent magnet pieces, the more flux from the permanent magnet pieces available.

Thus the flux density inside the core structure can be kept at a low level for higher currents.

When the separate core structures and the permanent magnets are identical (e.g., approximately identical), the inductances of separate inductors are also about the same. For example, the structure of FIG. 1 may have four separate coils wound on sides formed by the L-shaped structures 9, 10, 11, 12. When the number of turns on each coil is the same, the inductances of the coils are also the same.

Figure 6:
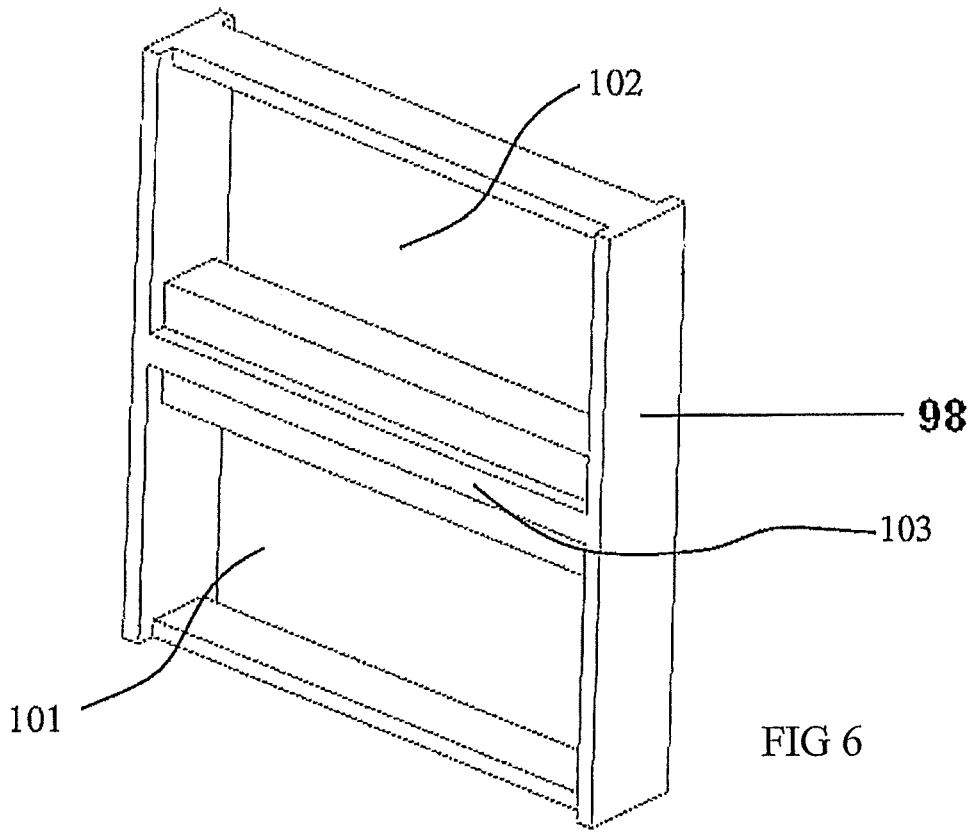
FIG. 6 shows an exemplary permanent magnet holder.

FIG. 6 shows an exemplary permanent magnet holder which is used according to an embodiment of the disclosure to hold permanent magnets in place with respect to each other. Further, the holder protects the permanent magnets from mechanical impact by surrounding them. The permanent magnets are placed inside holder windows 101, 102, and free surfaces of the permanent magnets are placed towards inductor structures. The holder of FIG. 6 can be used with structures shown in FIGS. 1, 2, 3, and 5. Two windows are separated from each other by a protrusion 103 which forms a gap between the magnets. The holder also helps in positioning the magnets precisely inside the structure.

In the above, the core structures are defined as being L-shaped or T-shaped. It is, however, clear that the structure of the present disclosure can be achieved with other possibilities. The drawings presented are only examples of multiple possibilities of achieving the structure of the disclosure.

It will be apparent to a person skilled in the art that the features disclosed herein can be implemented in various ways. The disclosure and its embodiments are not limited to the examples described above but may vary within the scope of the claims.

Thus, it will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

What is claimed is:

1. A permanent magnet DC inductor, comprising:

at least two separate magnetic inductors, each inductor having a core structure and forming closed individual magnetic paths, wherein each core structure includes two side legs and a center leg having a first portion that joins the side legs at one end of the core structure and a second portion that extends between the side legs and establishes a first magnetic gap with each side leg at another end of the core structure;

a winding provided on the second portion of the center leg of each core structure wherein the core structures of the separate inductors adjacent and have external magnetic gaps formed between adjacent side legs of each core structure and at most a second magnetic gap formed between the second portions of the center leg of each core structure, and wherein each core structure has at least one permanent magnet piece arranged inside each external magnetic gap.

2. The permanent magnet DC inductor as claimed in claim 1, wherein the magnetic inductors are arranged to form two separate inductive components coupled physically and magnetically by the at least one permanent magnet piece arranged in the external magnetic gaps.

3. The permanent magnet DC inductor as claimed in claim 1, wherein each permanent magnet piece is configured to produce magnetic fluxes arranged to flow in both of the separate magnetic cores.

4. The permanent magnet DC inductor as claimed in claim 1, wherein at least one of the windings of an individual inductor is configured to produce at least a magnetic flux which supports a magnetic flux produced by at least one of the permanent magnets.

5. The permanent magnet DC inductor as claimed in claim 1, wherein the at least one permanent magnet piece of each core structure is configured to produce magnetic fluxes that oppose a magnetic flux generated by the windings of each core structure.

6. The permanent magnet DC inductor as claimed in claim 1, wherein the magnetic gaps inside the individual magnetic inductors are positioned to offset each other.

7. The permanent magnet DC inductor as claimed in claim 1, wherein the magnetic gaps inside the individual inductors are non-uniform in shape.

8. The permanent magnet DC inductor as claimed in claim 1, wherein the in each core structure, the side legs and the center leg are arranged such that flux produced by the permanent magnet pieces flows via the side legs and center legs of both core structures, and flux generated by each winding flows in the separate core structures in which the respective windings are arranged.

9. The permanent magnet DC inductor as claimed in claim 1, wherein the core structures each comprise:

side legs, whereby flux produced by the at least one permanent magnet piece flows via the side legs of both core structures and the flux of the windings flows in the separate core structures in which the respective windings are arranged.

10. The permanent magnet DC inductor as claimed in claim 1, comprising:

a magnet holder for holding the at least one permanent magnet pieces for each core structure, which holder at least partially surrounds the at least one permanent magnet pieces to keep the magnets in position with respect to each other.

11. The permanent magnet DC inductor as claimed in claim 2, wherein the at least one permanent magnet piece is configured to produce magnetic fluxes arranged to flow in both of the separate magnetic cores.

12. The permanent magnet DC inductor as claimed in claim 11, wherein at least one of the windings of one of the core structures is configured to produce at least a magnetic flux which supports a magnetic flux produced by at least one of the permanent magnets.

13. The permanent magnet DC inductor as claimed in claim 12, wherein the at least one permanent magnet piece is configured to produce magnetic fluxes arranged to oppose a magnetic flux of the windings of two individual core structures.

14. The permanent magnet DC inductor as claimed in claim 13, wherein the magnetic gaps inside the individual magnetic inductors are positioned to offset each other.

15. The permanent magnet DC inductor as claimed in claim 14, wherein the magnetic gaps inside the individual inductors are non-uniform in shape.

16. The permanent magnet DC inductor as claimed in claim 15, wherein in each core structure, the side legs and the center leg are arranged such that flux produced by the permanent magnet pieces flows via the side legs and center legs of both core structures, and flux generated by each winding flows in the separate core structures in which the respective windings are arranged.

17. The permanent magnet DC inductor as claimed in claim 16, wherein in each core structure the side legs are arranged whereby flux produced by the at least one permanent magnet piece flows via the side legs of both core structures and the flux of the windings flows in the separate core structures in which the respective windings are arranged.

18. The permanent magnet DC inductor as claimed in claim 17, comprising:

a magnet holder for holding the at least one permanent magnet pieces for each core structure, which holder at least partially surrounds the at least one permanent magnet pieces to keep the magnets in position with respect to each other.

19. The permanent magnet DC inductor as claimed in claim 1, wherein the center leg is T-shaped and the side legs are L-shaped, and shorter sides of the side legs form the first magnetic gaps with the second portion of the center leg.

20. The permanent magnet DC inductor as claimed in claim 19, wherein the first magnetic gaps with the shorter sides are formed at opposite faces of the second portion of the center leg.

* * * * *

UNITED STATES PATENT AND TRADEMARK OFFICE

CERTIFICATE OF CORRECTION

PATENT NO. : 9,030,282 B2
APPLICATION NO. : 12/700252
DATED : May 12, 2015
INVENTOR(S) : Paulius Pieteris et al.

It is certified that error appears in the above-identified patent and that said Letters Patent is hereby corrected as shown below:

IN THE CLAIMS

Column 6, Line 23: Change "wherein the core structures of the separate inductors adjacent" to -- wherein the core structures of the separate inductors are adjacent --.

Signed and Sealed this
Sixth Day of October, 2015

Michelle K. Lee

Michelle K. Lee
*Director of the United States Patent and Trademark Office*